United States Patent [19]

Lewis

[11] 4,397,495

[45] Aug. 9, 1983

[54] AUTOMATIC GRIP CONTROL CIRCUIT FOR A GRAPPLE MECHANISM

[75] Inventor: Stephen A. M. Lewis, London, Canada

[73] Assignee: Clark Equipment Company, Buchanan, Mich.

[21] Appl. No.: 278,269

[22] Filed: Jun. 29, 1981

[51] Int. Cl.[3] ..... B66C 3/16; F15B 13/042

[52] U.S. Cl. ..... 294/88; 91/437; 414/730

[58] Field of Search ..... 294/86 R, 88, 106; 60/560, 562, 563; 91/421, 433, 437–441, 449–452; 414/621, 626, 730, 739

[56] References Cited

U.S. PATENT DOCUMENTS

| | | | |
|---|---|---|---|
| 3,407,951 | 10/1968 | Faust et al. | 294/88 X |
| 3,627,351 | 12/1971 | Zimmerman | 294/88 X |
| 3,631,989 | 1/1972 | McCormick | 414/734 |
| 3,854,766 | 12/1974 | Jordan | 294/88 |
| 3,865,424 | 2/1975 | Jabkowski | 294/88 |
| 3,905,635 | 9/1975 | Esser | 294/88 |
| 4,201,510 | 5/1980 | Muntjanoff | 414/730 |
| 4,313,633 | 2/1982 | Muntjanoff et al. | 294/88 |

*Primary Examiner*—Johnny D. Cherry
*Attorney, Agent, or Firm*—Harry G. Thibault

[57] ABSTRACT

An automatic grip control circuit for a grapple mechanism providing a first pilot circuit to actuate a main hydraulic valve which operates the grapple cylinder and a second pilot circuit to actuate a grip control valve which causes excess fluid to dump to tank when the pressure is too high or directs fluid to the first pilot circuit to reactivate the main control valve to increase pressure on the grapple cylinder when the pressure is too low. The automatic grip control circuit automatically senses changes in pressure to maintain adequate gripping pressure on logs held within the grapple tongs.

12 Claims, 3 Drawing Figures

AUTOMATIC GRIP CONTROL CIRCUIT FOR A GRAPPLE MECHANISM

BACKGROUND OF THE INVENTION

Log skidders used in forestry operations have a grapple mode in which a log grapple mechanism comprising a boom and grapple combination can be mounted on the rear of the skidder. The boom may be fixed with the grapple mechanism modified so it may be lowered to the ground or the boom may be hydraulically movable to lower the grapple to the ground. In either event, the grapple mechanism comprises a pair of reciprocally movable tongs which may be actuated by a first hydraulic cylinder or cylinders to open and close around a group of logs. Typically, in operation the grapple boom is lowered by means of a second hydraulic cylinder or cylinders with the grapple tongs open to engage a group of logs, then hydraulic pressure is applied to the cylinder or cylinders actuating the grapple mechanism to close the tongs about the group of logs. The boom or the grapple is then raised to lift a forward end of the logs off the ground. Then, the logs are dragged by the skidder to another location for loading or unloading.

One of the problems in the above sequence of events is that once the logs are gripped within the grapple tongs and are being dragged by the skidder there is a possibility that the logs will shift to create a smaller mass about which the grapple tongs are closed. Such shifting, if it is not corrected by a mechanism to maintain constant pressure on the logs, would cause the grapple tongs to open enough to permit the loss of a portion or even all of the load of logs requiring the operator to begin the operation of the grapple mechanism all over again and resulting in wasted effort and much inefficiency.

Accordingly, a number of solutions have been offered to the problem. In some cases a simple check valve has been disposed between the source of hydraulic fluid and the cylinder to maintain pressure in the lines. In other cases a hydraulic connection has been provided between the hydraulic cylinder operating the grapple and the hydraulic cylinder operating the boom to equalize pressure in both boom and grapple. A third form of solution is a pressure equalization circuit in which an excess pressure built up in the grapple actuates a pilot valve to dump excess fluid when the pressure is too high and increase fluid flow when the pressure is too low. All of these proposed solutions have shortcomings and thus the search for an ideal grip control circuit continues. The present circuit follows along the lines of the third alternative but offers a solution that is unique when compared to the available prior art.

SUMMARY OF THE INVENTION

The present invention provides two separable circuits, a first pilot circuit to actuate a main hydraulic valve that operates the grapple cylinder and a second pilot circuit to actuate a grip control valve which causes excess fluid to dump to tank when the pressure is too high or directs fluid to the pilot valve to reactivate the main control valve to increase pressure on the grapple cylinder when the pressure is too low. The hydraulic circuit of the present invention enables the tongs of a grapple mechanism to grip a load of logs at an initial holding pressure and to automatically retain such pressure regardless of any change in the relative positional relationship of the logs within the tongs and regardless of any forces which are applied to the logs in the course of their being moved from one location to another. The hydraulic circuit automatically senses changes in pressure to maintain adequate gripping pressure on the logs held within the grapple tongs.

A particular element of the present circuit which greatly enhances its operation is the arrangement between the automatic grip control valve and the on-off valve which provides an abrupt switching motion which enables the automatic grip control valve to abruptly switch the on-off valve from one port to the other rather than providing metered flow between the two ports during switching. The present arrangement prevents the "hunting" often encountered in hydraulic circuits of this type as well as assures the hydraulic isolation of the pilot circuit for the automatic grip control valve from the pilot circuit for the spool valve.

The invention is better understood by referring to the detailed description set forth below particularly when considered with the accompanying drawings.

DETAILED DESCRIPTION OF THE INVENTION

Figure 1:
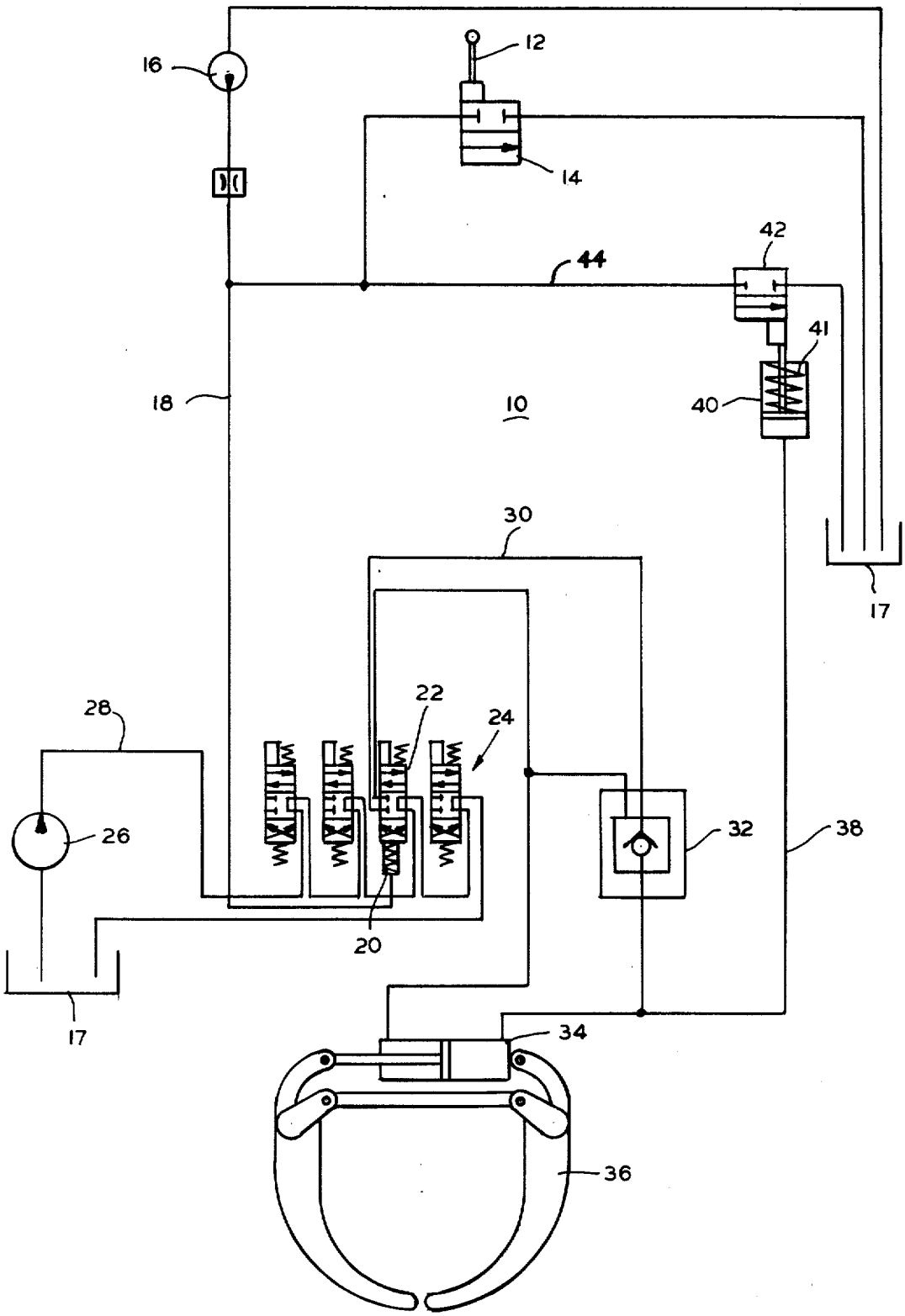
FIG. 1 is a diagrammatical view of the hydraulic circuit of the present invention.
Figure 2:
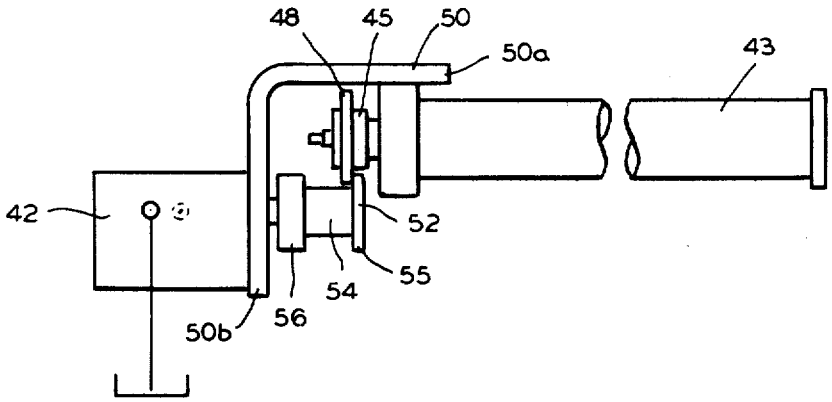
FIG. 2 is a side elevational view of the mechanical switching arrangement of the present invention in a first position.
Figure 3:
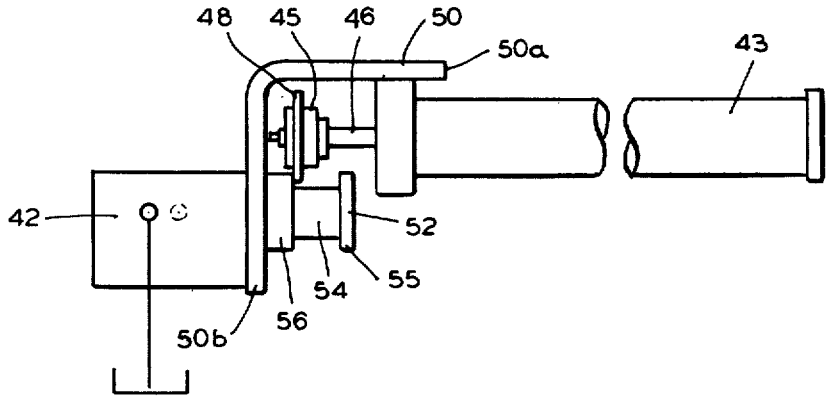
FIG. 3 is a side elevational view of the mechanical switching arrangement of the present invention in a second position.

Referring to the drawing, hydraulic circuit 10 comprises a grapple lever 12 connected to a selector valve 14. Selector valve 14 is the first on-off valve in the system. Actuation of the grapple lever 12 activates a transmission pump 16 carrying pilot fluid from tank 17 through the transmission pump 16 through hydraulic pilot line 18 to base 20 of a grapple spool 22 of a Parker 4-spool hydraulic flow control valve 24 to actuate the valve 24. Actuation of the grapple spool 22 of the valve 24 initiates hydraulic flow from the main pump 26 through hydraulic line 28 to grapple spool 22 and therethrough to hydraulic line 30, through lock valve 32 and into the grapple cylinder 34. Fluid flow from the grapple spool 22 through line 30, through lock valve 32, and into the grapple cylinder 34 maintains gripping pressure in the grapple cylinder 34 to close tongs 36. Hydraulic pilot line 38 is connected to an automatic grip control valve 40 which operates a second on-off valve 42 interposed between the transmission pump 16 and tank 17 in hydraulic line 44.

Automatic grip control valve 40 comprises a cylinder body 43 and a plunger head 45, the plunger head 45 mounted on a rod 46 associated with the automatic grip control valve 40 and having a flanged circumferential edge 48 extending outwardly therefrom. Cylinder 43 of the grip control valve 40 is mounted at its upper end to a mounting bracket 50. The mounting bracket 50 is L-shaped with the cylinder 43 of the automatic grip control valve 40 mounted at its upper end on a first leg **50*a* of the L-shaped bracket 50 and the on-off valve 42 mounted on a second leg 50*b* of the L-shaped bracket 50. The on-off valve 42 includes a plunger 52 having a narrowed portion 54 between opposite shoulders 55 and 56 of the plunger 52**. The automatic grip control valve 40 and the on-off valve 42 are so mounted on the L-shaped bracket 50 that the flange portion 48 of the plunger head 45 intrudes into the space between shoulders 55 and 56 of the plunger 52. Operation is set forth below.

Operation is as follows. When the grapple lever 12 is actuated, the selector valve 14 is operated to close flow between the transmission pump 16 and tank 17 and direct flow from the transmission pump 16 through hydraulic pilot line 18 to the base of grapple spool 22 actuating hydraulic flow from the main pump 26 through transmission line 28, through the grapple spool 22, through line 30, through lock valve 32 and into grapple cylinder 34 to maintain a high level of fluid pressure in the grapple cylinder 34 when the grapple mechanism is closed. The lock valve 32 maintains hydraulic pressure levels in the grapple cylinder 34. A second fluid pilot line 38 connected to automatic grip control valve 40 then is operable when fluid pressure from the main pump 26 rises above a predetermined level to actuate the automatic grip control valve 40 by directing fluid against a spring-loaded portion 41 thereof to actuate second on-off valve 42 to open fluid flow from the transmission pump 16 to tank 17.

The particular arrangement of the automatic grip control valve 40 and the on-off valve 42 provides that when the automatic grip control valve is actuated the plunger head 45 moves upwardly with the flange 48 moving upwardly from a point adjacent lower shoulder 55 to engage upper shoulder 56 to open the valve 42 to permit fluid flow from the transmission pump 16 to the tank 17. Thus, the plunger head 45 moves a considerable distance before there is even any contact between the automatic grip control valve 40 and the on-off valve 42 and then a very slight amount of additional upward movement actuates the on-off valve 42 to initiate flow from the transmission pump 16 to tank 17. Such an arrangement eliminates metering between the two ports of the on-off valve 42 so that there is a distinct and rapid shift from a no-flow to flow condition. Such an arrangement prevents "hunting" of the hydraulic circuit operating the grapple to assure distinct flow-no flow conditions.

Should fluid flow to the automatic grip control valve 40 moderate or decrease the automatic grip control valve 40 would then shift to the initial or closed position whereby fluid flow then would resume from tank 17 to the transmission pump 16 to the base of the grapple spool 22 to reactuate the grapple spool 22 and reinitiate the fluid flow from the main pump 26 to the grapple cylinder 34.

Mechanical operation of valves 40 and 42 are as follows when fluid flow to the automatic grip control valve 40 is decreased. Plunger head 45 will begin to retract with flange 48 moving downwardly from contact of its upper edge with the shoulder 56 through the narrowed portion 54 of the plunger 52 to engage lower shoulder 55 near the end of its travel. Further retraction of the plunger head 45 shifts the spool of the on-off valve 42 to a closed position to again initiate flow from the transmission pump to the pilot circuit actuating the main hydraulic valve 24.

It can be readily seen from the physical arrangement of valves 40 and 42 that an additional advantage of the present invention is that the pilot circuit operating the automatic grip control valve 40 is hydraulically independent and separate from the pilot circuit associated with the on-off valve 42 since there are no fluid connections between the two valves.

The specification set forth above describes the preferred embodiment of the present invention. However, certain modifications and improvements will become obvious to those skilled in the art upon a careful reading of this disclosure and consideration of the drawing accompanying it. Applicant's intention is that all such modifications and improvements be included within the scope of the present invention and that such invention not be limited to the preferred specific embodiment as described. The scope of Applicant's invention is defined by the claims appended below.

I claim:

1. An automatic grip control circuit for a grapple mechanism comprising grapple tongs operable by a hydraulic grapple cylinder to reciprocally open and close about a load of logs and the grip control circuit being operatively connected to the hydraulic grapple cylinder, said circuit comprising:

a main hydraulic pump connected to a main fluid supply tank for supplying hydraulic fluid to the grapple cylinder, a first on-off valve operative to provide pilot pressure to a main hydraulic actuating valve for the circuit, a first pilot line provided between the first on-off valve and the main hydraulic actuating valve to provide fluid to actuate a spool valve of the main hydraulic actuating valve for the grapple cylinder, a main hydraulic line provided from the main pump through the spool valve to the grapple cylinder to actuate said cylinder, a second pilot line provided in the main hydraulic line between the grapple cylinder and an automatic grip control valve, and a second on-off valve actuatable from a first or closed position to a second or open position by the automatic grip control valve to direct excess fluid to the main fluid supply tank and actuatable from the second or open position to the first or closed position by the automatic grip control valve to direct hydraulic fluid to the main hydraulic actuating valve to increase pressure in the grapple cylinder.

2. An automatic grip control circuit for a grapple mechanism as claimed in claim 1 including:

a lock valve connected between the main hydraulic actuating valve and the grapple cylinder to maintain pressure in the grapple cylinder after the grapple cylinder has been actuated to engage a load.

3. An automatic grip control circuit for a grapple mechanism as claimed in claim 1 wherein a grapple lever is provided to actuate the first on-off valve to provide pilot pressure to the main hydraulic actuating valve.

4. An automatic grip control circuit for a grapple mechanism as claimed in claim 1 wherein the automatic grip control valve is spring biased to maintain the second on-off valve in the first or closed position.

5. An automatic grip control circuit for a grapple mechanism as claimed in claim 1 wherein the automatic grip control valve and the second on-off valve are operatively mounted to provide a mechanical connection therebetween for relative reciprocal movement, the mechanical connection requiring a relatively longer movement of the automatic grip control valve than the movement of the second on-off valve so as to eliminate metered flow between first and second ports of the second on-off valve.

6. An automatic grip control circuit for a grapple mechanism as claimed in claim 5 wherein the particular mechanical arrangement between the automatic grip control valve and the second on-off valve provides an L-shaped bracket having the automatic grip control valve mounted on one leg thereof and the second on-off valve mounted on the second leg thereof, a plunger associated with the automatic grip control valve engaging a plunger associated with the second on-off valve.

7. An automatic grip control circuit for a grapple mechanism as claimed in claim 5 wherein a plunger of the automatic grip control valve is aligned in a parallel relationship with a plunger of the second on-off valve for relative reciprocal movement therebetween, an outwardly extending portion of the automatic grip control valve plunger extending into a narrowed portion of the on-off valve plunger provided between two adjacent shoulder portions of the on-off valve plunger whereby initial movement of the plunger of the automatic grip control valve is within the narrowed portion of the plunger of the second on-off valve between the first and second shoulder portions of the second on-off valve, so that no opening or closing of the second on-off valve occurs until the plunger of the automatic grip control valve has traveled from the first shoulder portion to the second shoulder portion to engage therewith or vice versa.

8. An automatic grip control circuit for a grapple mechanism comprising grapple tongs operable by a hydraulic grapple cylinder to reciprocally open and close about a load of logs and the grip control circuit being operatively connected to the hydraulic grapple cylinder, said circuit comprising:

a main hydraulic pump connected to a main fluid supply tank for supplying hydraulic fluid to the grapple cylinder, a first pilot line connected to a main hydraulic actuating valve to provide fluid to actuate a spool valve of the main hydraulic actuating valve for the grapple cylinder, a main hydraulic line provided from the main pump through the spool valve to the grapple cylinder to actuate said cylinder, a second pilot line provided in the main hydraulic line between the grapple cylinder and an automatic grip control valve, and a second pilot line on-off valve actuatable from a first or closed position to a second or open position by the automatic grip control valve to direct excess fluid to the main fluid supply tank and actuatable from the second or open position to the first or closed position by the automatic grip control valve to direct hydraulic fluid to the main hydraulic actuating valve to increase pressure in the grapple cylinder, the automatic grip control valve and the second pilot line on-off valve being operatively mounted to provide a mechanical connection therebetween for relative reciprocal movement, the mechanical connection requiring a relatively longer movement of the automatic grip control valve than the movement of the on-off valve to shift the on-off valve from said first position to said second position and return so as to eliminate metered flow between first and second ports of the on-off valve.

9. An automatic grip control circuit for a grapple mechanism as claimed in claim 8 including a first pilot line on-off valve operative to provide pilot pressure to the main hydraulic actuating valve for the circuit.

10. An automatic grip control circuit for a grapple mechanism as claimed in claim 9 wherein the particular mechanical arrangement between the automatic grip control valve and the second pilot line on-off valve provides an L-shaped bracket having the automatic grip control valve mounted on one leg thereof and the second pilot line on-off valve mounted on the second leg thereof, a plunger associated with the automatic grip control valve engaging a plunger associated with the second pilot line on-off valve.

11. An automatic grip control circuit for a grapple mechanism as claimed in claim 10 wherein the plunger of the automatic grip control valve is aligned in a parallel relationship with the plunger of the second pilot line on-off valve for relative reciprocal movement therebetween, an outwardly extending portion of the automatic grip control valve plunger extending into a narrowed portion of the on-off valve plunger provided between two adjacent shoulder portions of the on-off valve plunger whereby initial movement of the plunger of the automatic grip control valve is within the narrowed portion of the plunger of the second pilot line on-off valve between the first and second shoulder portions of the on-off valve, so that no opening or closing of the on-off valve occurs until the plunger of the automatic grip control valve has traveled from the first shoulder portion to the second shoulder portion to engage therewith or vice versa.

12. An automatic grip control circuit for a grapple mechanism as claimed in claim 8 including:

a lock valve connected between the main hydraulic actuating valve and the grapple cylinder to maintain pressure in the grapple cylinder after the grapple cylinder has been actuated to engage a load.

* * * * *